US007258146B2

(12) United States Patent
Williams et al.

(10) Patent No.: US 7,258,146 B2
(45) **Date of Patent: *Aug. 21, 2007**

(54) BRIDGE AND ADAPTER FOR BAG-IN-BOX FILLER

(75) Inventors: Thomas J. Williams, Lutz, FL (US); William A. Cataldo, Bradenton, FL (US)

(73) Assignee: Tropicana Products, Inc., Bradenton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/320,433

(22) Filed: Dec. 28, 2005

(65) Prior Publication Data

US 2006/0144466 A1 Jul. 6, 2006

Related U.S. Application Data

(62) Division of application No. 10/613,859, filed on Jul. 3, 2003, now Pat. No. 6,981,534.

(51) Int. Cl.
*B65B 1/04* (2006.01)

(52) U.S. Cl. ..... 141/384; 141/346; 141/386

(58) Field of Classification Search ..... 141/18, 141/285, 290–292, 313–317, 346, 382–386; 137/614.04; 251/149.1; 220/685; 285/374, 285/377

See application file for complete search history.

(56) References Cited

U.S. PATENT DOCUMENTS 2,954,901 A 10/1960 Winstead
3,054,549 A 9/1962 Humphrey
3,081,911 A 3/1963 Scholle
3,138,293 A * 6/1964 Roak et al. ..... 222/105
4,138,036 A 2/1979 Bond
4,286,636 A 9/1981 Credle
4,560,090 A 12/1985 Okushita
4,601,410 A 7/1986 Bond
4,815,631 A 3/1989 Eeg et al.
5,425,479 A 6/1995 Credle, Jr.
5,445,186 A 8/1995 Richter et al.
5,609,195 A 3/1997 Stricklin et al.
5,749,493 A 5/1998 Boone et al.
5,941,421 A 8/1999 Overman et al.
5,988,230 A 11/1999 Black et al.
6,012,611 A 1/2000 Schroeder
6,102,252 A 8/2000 Overman et al.
6,702,337 B2 3/2004 Rutter et al.

* cited by examiner

*Primary Examiner*—Timothy L. Maust
(74) *Attorney, Agent, or Firm*—Banner & Witcoff, Ltd.

(57) ABSTRACT

A bridge and adapter system for a bag-in-box packaging filler is shown to include an adapter providing a quick connection between the supply line and the dispensing member of the bag-in-box packaging. A bridge is adapted to sit longitudinally across the box of the bag-in-box packaging and is adapted to engage with both the adapter and the dispensing member of the bag-in-box packaging in order to provide support of the adapter and dispensing member, therein. The adapter includes air vents which facilitate the escape of air in the bag-in-box while it is being displaced with other contents from the supply line. The upper end portion of the adapter includes a cam lock connector for connecting the supply line.

7 Claims, 2 Drawing Sheets

BRIDGE AND ADAPTER FOR BAG-IN-BOX FILLER

CROSS-REFERENCE TO RELATED APPLICATION

This is a divisional of U.S. application Ser. No. 10/613,859, filed Jul. 3, 2003, now U.S. Pat. No. 6,981,534, the entire specification of which is incorporated herein by reference.

BACKGROUND OF THE INVENTION

The present invention generally relates to a bag-in-box packaging filler, and more specifically, to a bridge and adapter system for filling bag-in-box packaging, wherein said adapter provides means for quickly connecting the supply line to the dispensing member of the bag-in-box while concurrently allowing air to vent from the bag-in-box as it is being filled, and said bridge provides means for supporting the dispensing member of the bag-in-box and the adapter.

Conventional bag-in-box packaging is generally characterized as being a lightweight, durable and low cost means for shipping liquids, powders, semi-solids and the like. Bag-in-box packaging generally comprises a container constructed of a stiff, durable, yet inexpensive material such as paperboard or corrugated board. This container includes a flexible liner or bag therein for holding liquids, powders, semi-solids and the like. Integrally attached to the flexible liner or bag is a closable dispensing member. This dispensing member is typically placed within the container during shipping in order to prevent any accidental spillage and is later expressed therefrom during the dispensing of its contents.

During packaging and before shipping, it is therefore desirable to quickly fill the bag-in-box without losing any of its contents. In view of the foregoing, it is desirable to develop an efficient means for filling bag-in-box packaging.

It is further desirable to develop an adapter for a bag-in-box filler which provides means for quickly connecting the supply line to the dispensing member of the bag-in-box.

It is further desirable to develop an adapter for a bag-in-box filler which provides means for venting air from the bag-in-box as it is being filled.

It is further desirable to develop an adapter for a bag-in-box filler constructed of a durable material such as food grade stainless steel, plastic, or aluminum.

It is further desirable to develop a bridge for a bag-in-box filler which provides means for supporting the dispensing member of the bag-in-box and the adapter.

It is further desirable to develop a bridge for a bag-in-box filler constructed of a durable material such as food grade stainless steel, plastic, or aluminum.

These and other desired benefits of the preferred forms, including combinations of features thereof, of the invention will become apparent from the following description. It will be understood, however, that a device could still appropriate the claimed invention without accomplishing each and every one of these desired benefits, including those gleaned from the following description. The appended claims, not these desired benefits, define the subject matter of the invention. Any and all benefits are derived from the preferred forms of the invention, not necessarily the invention in general.

SUMMARY OF THE INVENTION

In view of the desired goals of the invention claimed herein, the bridge and adapter system for a bag-in-box packaging filler provides a quick connection between the supply line and the dispensing member in the bag-in-box packaging. This system comprises a bridge adapted to sit longitudinally across the box of the bag-in-box packaging. The bridge includes an aperture adapted to support and secure the dispensing member of the bag-in-box packaging. The bridge further includes hold down tabs on its top side adapted to engage, secure, and support an adapter through a rotatable collar situated on the lower end portion of said adapter. The rotatable collar preferably includes air vents which facilitate the escape of air in the bag-in-box while it is being displaced with other contents from the supply line. The upper end portion of the adapter includes a cam lock connector for connecting the supply line.

BRIEF DESCRIPTION OF THE SEVERAL VIEWS OF THE DRAWINGS

Throughout this description, reference has been and will be made to the accompanying views of the drawing wherein like subject matter has like reference numerals, and wherein.

DETAILED DESCRIPTION OF THE PREFERRED EMBODIMENTS

Figure 1:
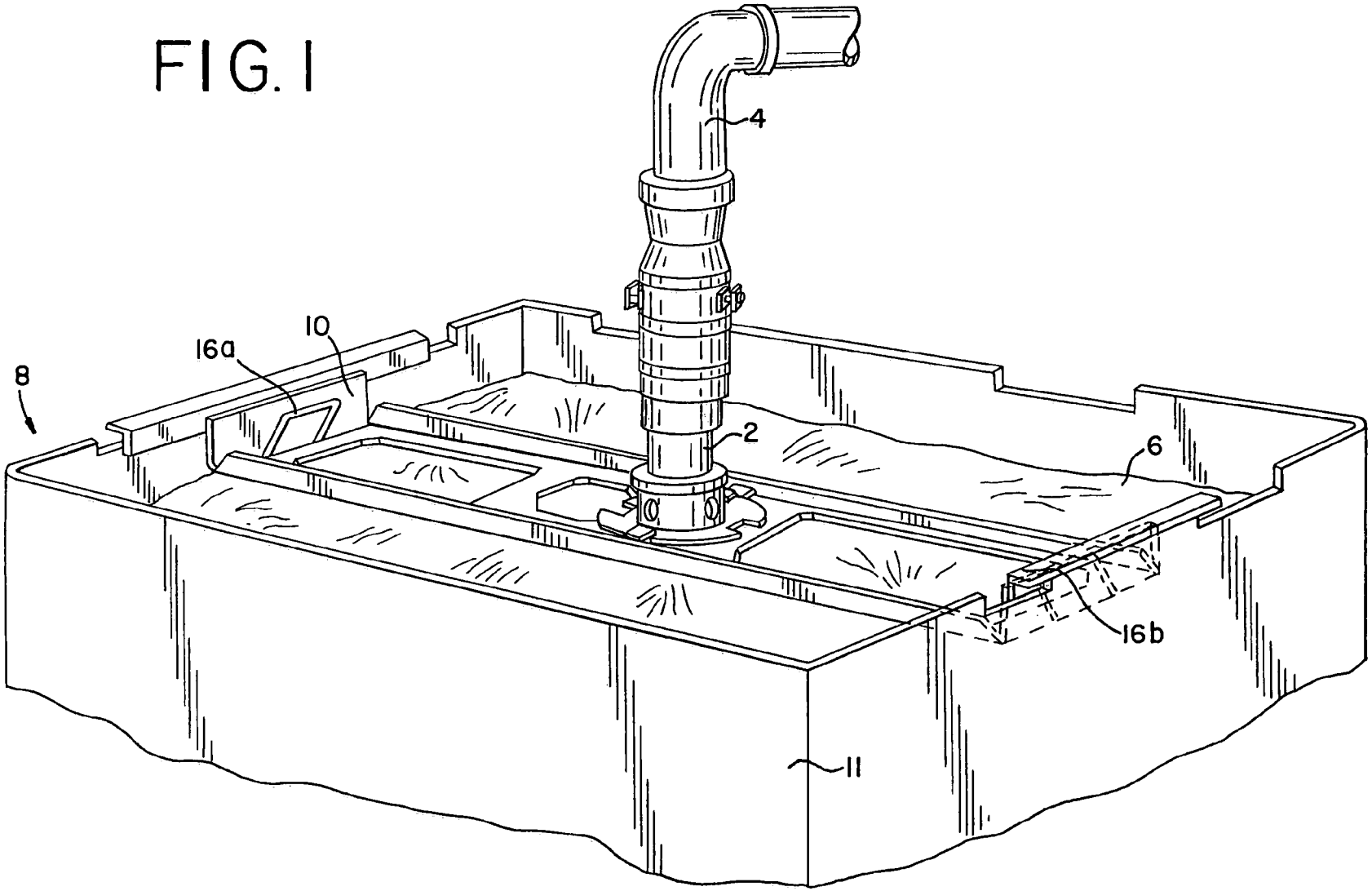
FIG. 1 is a perspective view showing the supply hose being connected to the dispensing member of the bag-in-box with the bridge and adapter system.
Figure 2:
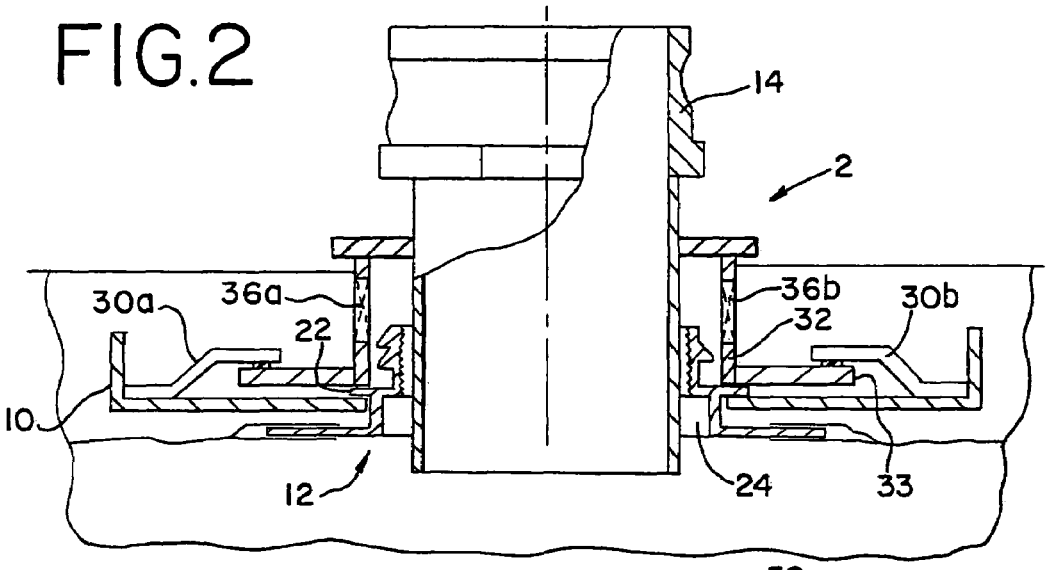
FIG. 2 is a partial cross sectional view showing the engagement between the bridge, dispensing member of the bag-in-box, and adapter.
Figure 3:
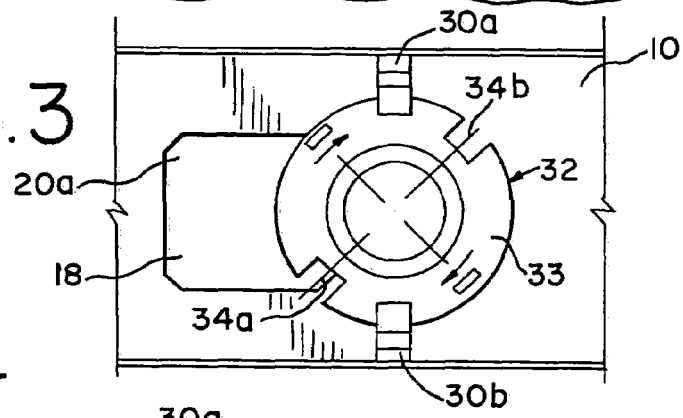
FIG. 3 is a top plan view of the bridge, dispensing member of the bag-in-box, and adapter engagement as shown in FIG. 2.
Figure 4:
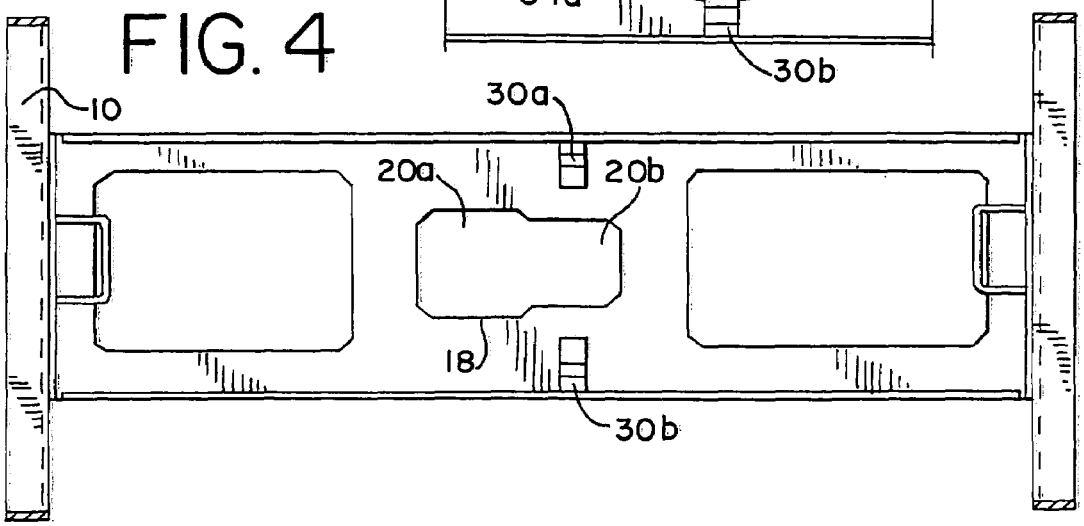
FIG. 4 is a top plan view of the bridge for a bag-in-box filler.
Figure 5:
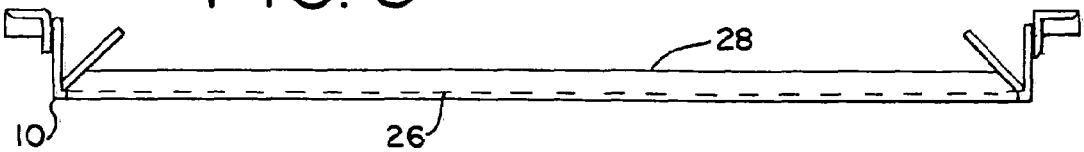
FIG. 5 is side elevational view of the bridge as shown in FIG. 4.

The bridge and adapter system for a bag-in-box packaging filler is preferably constructed of a durable material such as stainless steel, plastic, or aluminum. It is important to note that it would be especially desirable for this system to be constructed of food-grade material as this system primarily serves in the transport of consumable materials to the bag-in-box packaging. The general structure of a preferred embodiment of the bridge and adapter system for a bag-in-box packaging filler is best generally illustrated in FIG. 1. An adapter 2 generally provides a quick connection between the supply line 4 and the bag 6 in the bag-in-box packaging, generally designated at 8. A bridge 10 is adapted to sit longitudinally across the box 11 of the bag-in-box packaging 8 and is adapted to engage with both the adapter 2 and the dispensing member 12 (shown in FIG. 2) of the bag-in-box packaging 8 in order to provide support of the adapter 2 and dispensing member 12, therein. It is important to note that the bridge 10 further comprises handles 16*a*, 16*b* at the ends of the bridge 10 for easy placement and displacement from the box 11.

More specifically and now turning to FIGS. 2–5, the upper end of the adapter 2 includes a male cam lock connector 14 in order to provide quick connection between the supply line 4 and adapter 2. The bridge 10 is supported by the box 11 by being placed longitudinally across the box 11 of the bag-in-box packaging 8. The bridge 10 includes an aperture 18 having a larger open section 20*a* and a smaller open section 20*b* opening into each other. The periphery of the larger open section 20*a* is greater than that of the smaller open section 20*b*. The aperture 18 can be generally situated in the center of the bridge 10.

The dispensing member 12 of the bag-in-box packaging comprises a collar 22 about its mouth 24. During installation, the mouth 24 of the dispensing member 12 is inserted through the bottom side 26 of the bridge 10 via the larger open section 20*a* of the aperture 18, such that the collar 22 rises above the top side 28 of the bridge 10. The dispensing member 12 is then longitudinally displaced toward the smaller open section 20*b* of the aperture 18, such that the collar 22 now sits above the top side 28 of the bridge 10. In this way, the dispensing member 12 of the bag-in-box packaging is secured and supported.

The lower end portion of the adapter 2, which is cam locked to the supply line 4 by the upper end portion of the adapter, is placed within the mouth 24 of the dispensing member 12, which is secured to the bridge 10. In order to secure and support the adapter 2 and supply line 4, the bridge 10 includes at least one hold-down member. The illustrated embodiment shows two hold-down tabs 30*a*, 30*b* on the top side 28 of the bridge 10 located opposite of one another and perpendicularly situated in relation to the smaller open section 20*b* of the aperture 18 of the bridge 10.

The adapter 2 includes a rotatable collar, generally designated at 32, having on its bottom portion a ridge 33 protruding circumferentially outward therefrom with at least one member for interacting with the hold-down member of the bridge. In the illustrated embodiment, this interacting member takes the form of two notches 34*a*, 34*b*. Notches 34*a*, 34*b* can have generally the same shape and size of the two hold-down tabs 30*a*, 30*b* of the bridge 10, although typically the notches will be at least slightly larger so as to accommodate the passage of the hold-down tabs 30*a*, 30*b* therethrough. Notches 34*a*, 34*b* are oriented with respect to each other in the same manner that the hold-down tabs 30*a*, 30*b* are oriented. In the illustrated embodiment, this orientation is about 180°; so each notch 34*a*, 34*b* is located generally opposite the other. A 90° orientation is also possible for example.

As the lower end portion of the adapter 2 is placed within the mouth 24 of the dispensing member 12, the notches 34*a*, 34*b* of the ridge 33 of the rotatable collar 32 are aligned with the hold-down tabs 30*a*, 30*b* such that the ridge 33 of the rotatable collar 32 lies below the hold-down tabs 30*a*, 30*b*. The rotatable collar 32 is rotated such that the ridge 33 engages with the hold-down tabs 30*a*, 30*b* such that the adapter and supply line assembly is supported and secured by the bridge. In this manner, the supply line 4, adapter 2, and dispensing member 12 of the bag-in-box packaging are secured and supported in order to facilitate fast and efficient filling of the bag-in-box packaging.

Preferably, the adapter 2 further includes air vents 36*a*, 36*b* situated about its rotatatable collar 32. One skilled in the art will recognize that the contents being filled within the bag 6 will displace the air therein. Accordingly, it is desirable to provide a manner by which the air will escape therefrom during filling in order to facilitate most efficient filling. In one embodiment, air travels from the dispensing member 12 of the bag 6 between the mouth 24 of the dispensing member 12 and the lower end portion of the adapter 2. The air then travels through the rotatable collar 32 and escapes from the air vents 36*a*, 36*b*.

While this invention has been described with reference to certain illustrative aspects, it will be understood that this description shall not be construed in a limiting sense. Rather, various changes and modifications can be made to the illustrative embodiments without departing from the true spirit and scope of the invention, as defined by the following claims. Furthermore, it will be appreciated that any such changes and modifications will be recognized by those skilled in the art as an equivalent to one or more elements of the following claims, and shall be covered by such claims to the fullest extent permitted by law.

The invention claimed is:

1. A bridge for use with a filler system for a bag-in-box container having top, bottom and side walls and a dispensing member with a mouth and a collar located about the mouth said bridge, comprising:

a top side, a bottom side and two longitudinal ends of said bridge being supportable by the bag-in-box container at least at one end adjoinable with at least one side wall of the container, an aperture through the bridge, said aperture having a larger open section that is sized and shaped to accommodate passage from one side of the bridge to the other of a dispensing member of a bag-in-box container, a smaller open section of said aperture, said smaller open section being in direct communication with said larger open section, said smaller open section being sized and shaped to accommodate displacement of the dispensing member from said larger open section to said smaller open section for securing the dispensing member to the bridge; and wherein said bridge is further adapted to span the top of the bag-in-box container and to extend from one container side wall to a second, opposing container side wall.

2. The bridge as defined by claim 1, wherein said aperture larger open section and smaller open section are adapted such that when the mouth of said dispensing member is inserted through the bottom side of said bridge through the larger open section and displaced toward the smaller open section, the collar of the mouth of said dispensing member is positioned above and is supported by the top side of the bridge.

3. The bridge as defined by claim 1, wherein said top side of the bridge further includes a hold-down member, said hold-down member being adapted to engage with an adapter having a rotatable collar with a ridge protruding circumferentially outward therefrom.

4. The bridge as defined by claim 1 wherein the aperture is disposed between two opposing ends of the bridge and each end is supported at an opposing side wall of the bag-in-box container.

5. The bridge as defined in claim 1 wherein each of the two longitudinal ends further comprise handles.

6. The bridge as defined in claim 1 wherein each of the two longitudinal ends further comprise handles.

7. The bridge as defined in claim 4 wherein each of the two longitudinal ends further comprise handles.

* * * * *